US009734696B1

(12) United States Patent
Smoot

(10) Patent No.: US 9,734,696 B1
(45) Date of Patent: Aug. 15, 2017

(54) MEDICATION REMINDER ASSEMBLY

(71) Applicant: Sheila Smoot, Bel Alton, MD (US)

(72) Inventor: Sheila Smoot, Bel Alton, MD (US)

( * ) Notice: Subject to any disclaimer, the term of this patent is extended or adjusted under 35 U.S.C. 154(b) by 0 days.

(21) Appl. No.: 15/080,920

(22) Filed: Mar. 25, 2016

(51) Int. Cl.
*G08B 1/00* (2006.01)
*G08B 21/24* (2006.01)
*A61J 1/03* (2006.01)

(52) U.S. Cl.
CPC ..... *G08B 21/24* (2013.01); *A61J 1/03* (2013.01); *A61J 2200/70* (2013.01)

(58) Field of Classification Search
CPC ..... A16J 7/04; A16J 1/00; G08B 21/24
USPC ..... 340/309.7, 573.1, 309.16, 407.1, 815.4, 340/384.1
See application file for complete search history.

(56) References Cited

U.S. PATENT DOCUMENTS 5,200,891 A 4/1993 Kehr et al.
5,805,051 A 9/1998 Herrmann et al.
5,954,225 A * 9/1999 Powe ..... A61J 7/0481 206/459.1
6,102,855 A * 8/2000 Kehr ..... A61B 5/0002 206/561
6,581,797 B2 6/2003 McKinney, Jr. et al.
6,985,869 B1 * 1/2006 Stoll ..... G06F 19/3406 600/301
7,158,011 B2 * 1/2007 Brue ..... A61J 7/0481 340/309.16
D610,796 S 3/2010 Siegel
9,311,452 B2 * 4/2016 Dickie ..... A61J 1/03
2011/0190928 A1 * 8/2011 Jeyarajan ..... B65D 83/00 700/232
2013/0134180 A1 5/2013 Cheyene
2016/0151246 A1 * 6/2016 Sotelo ..... A61J 7/0084 221/1

FOREIGN PATENT DOCUMENTS

WO WO2006071669 7/2006

* cited by examiner

*Primary Examiner* — Phung Nguyen

(57) ABSTRACT

A medication reminder assembly includes a box that may have medication placed therein. An alarm unit is coupled to the box and the alarm unit may be manipulated. The alarm unit is programmable to emit a selected one of an audible alarm, a vibratory alarm and a visual alarm at selected intervals. Thus, the alarm unit generates a reminder to take the medication within the box.

12 Claims, 5 Drawing Sheets

MEDICATION REMINDER ASSEMBLY

BACKGROUND OF THE DISCLOSURE

Field of the Disclosure

The disclosure relates to reminder devices and more particularly pertains to a new reminder device for reminding medication to be taken in specified combinations and at specified times of day.

SUMMARY OF THE DISCLOSURE

An embodiment of the disclosure meets the needs presented above by generally comprising a box that may have medication placed therein. An alarm unit is coupled to the box and the alarm unit may be manipulated. The alarm unit is programmable to emit a selected one of an audible alarm, a vibratory alarm and a visual alarm at selected intervals. Thus, the alarm unit generates a reminder to take the medication within the box.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
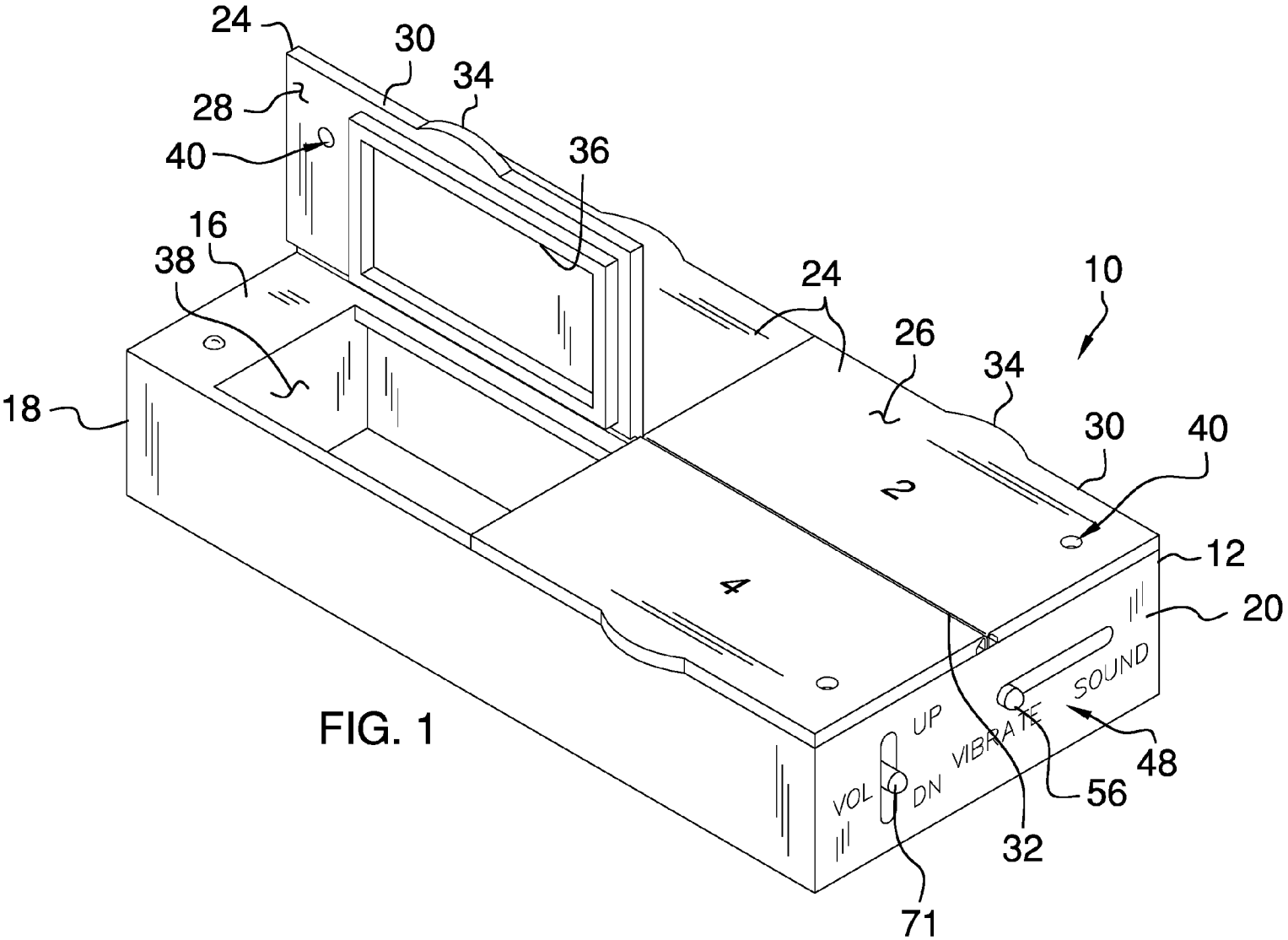
FIG. 1 is a top perspective view of a medication reminder assembly according to an embodiment of the disclosure.
Figure 2:
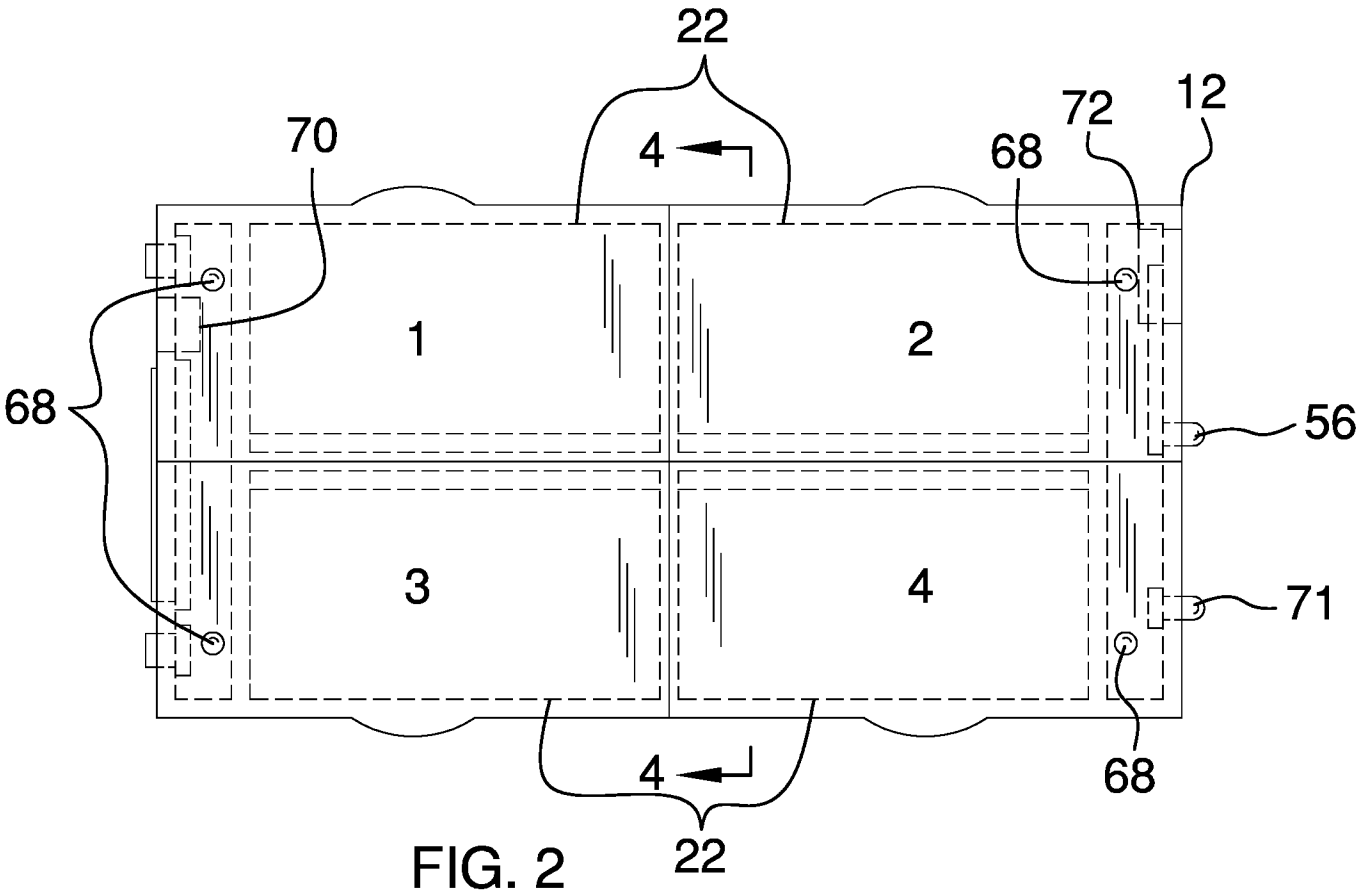
FIG. 2 is a top phantom view of an embodiment of the disclosure.
Figure 3:
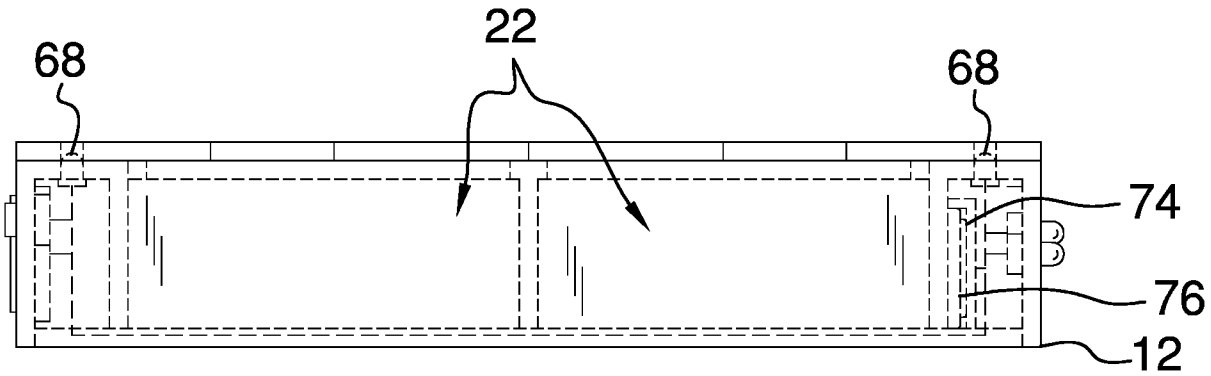
FIG. 3 is a front phantom view of an embodiment of the disclosure.
Figure 4:
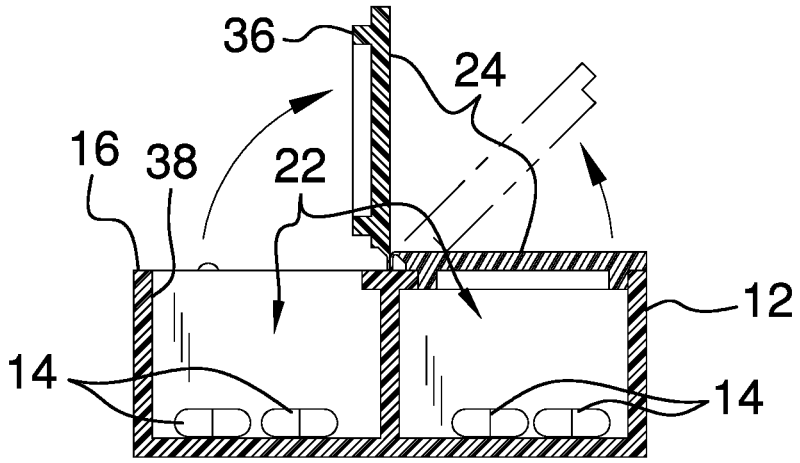
FIG. 4 is a cross sectional view taken along line 4-4 of FIG. 2 of an embodiment of the disclosure.
Figure 5:
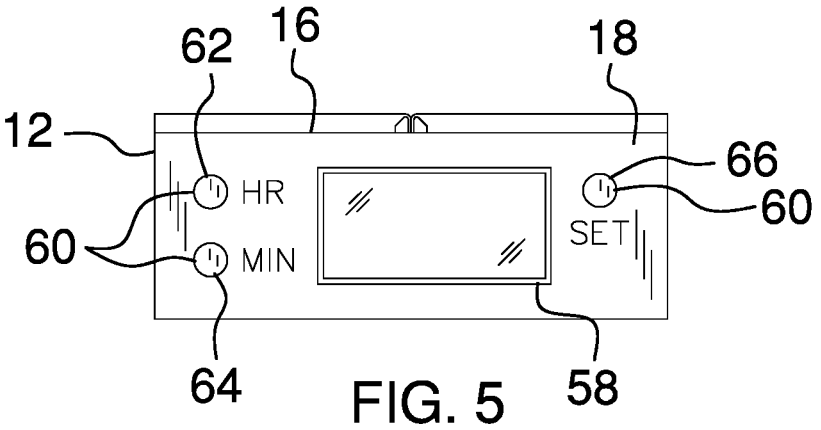
FIG. 5 is a left side view of an embodiment of the disclosure.
Figure 6:
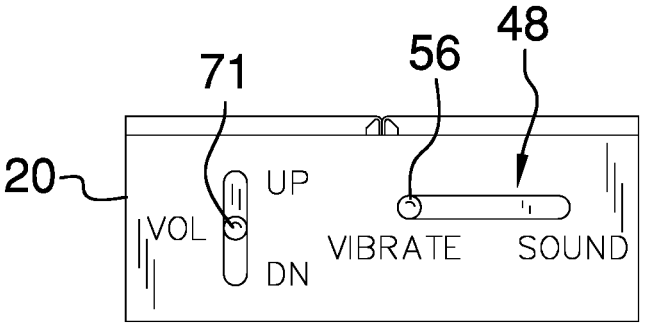
FIG. 6 is a right side view of an embodiment of the disclosure.
Figure 7:
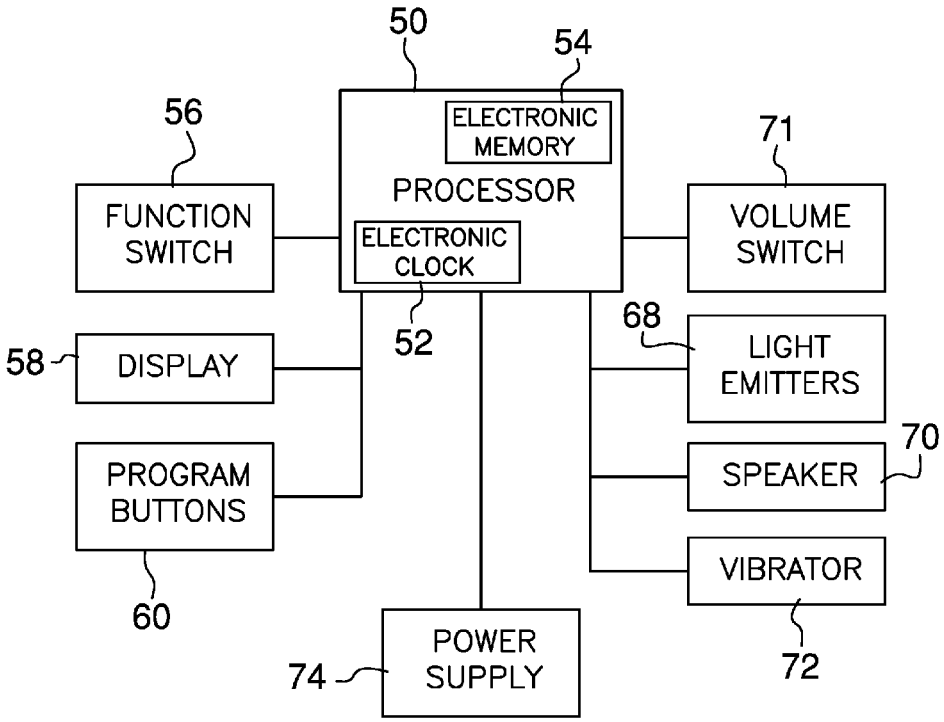
FIG. 7 is a schematic view of an embodiment of the disclosure.

With reference now to the drawings, and in particular to FIGS. 1 through 7 thereof, a new reminder device embodying the principles and concepts of an embodiment of the disclosure and generally designated by the reference numeral 10 will be described.

As best illustrated in FIGS. 1 through 7, the medication reminder assembly 10 generally comprises a box 12 that may have medication 14 placed therein. The medication 14 may comprise pills or the like. The box 12 has a top side 16, a first lateral side 18 and a second lateral side 20. The top side 16 has a plurality of wells 22 extending downwardly therein. The medication 14 may be placed in each of the wells 22. The wells 22 are spaced apart from each other and are distributed on the top side 16.

A plurality of lids 24 is provided and each of the lids 24 is hingedly coupled to the top side 16 of the box 12. The lids 24 may be manipulated thereby facilitating the lids 24 to retain the medication 14 within the box 12. Each of the lids 24 is aligned with an associated one of the wells 55. Each of the lids 24 is positionable in an open position and a closed position.

Each of the lids 24 has an upper surface 26, a lower surface 28, an outwardly facing edge 30 and an inwardly facing edge 32. A tab 34 may extend outwardly from the outwardly facing edge 30 corresponding to each of the lids 24. Thus, the tab 34 on each of the lids 24 may be gripped to position the corresponding lid 24 in the open position. The inwardly facing edge 32 corresponding to each of the lids 24 may be hingedly coupled to the top side 16 of the box 12.

A ledge 36 may extend downwardly from the lower surface 28 of each of the lids 24. The ledge 36 may be substantially coextensive with a bounding surface 38 of the associated well 22. The ledge 36 may frictionally engage the bounding surface 38 of the associated well 22. Thus, the lids 24 are frictionally retained in the closed position.

Each of the lids 24 has an aperture 40 extending through the upper surface 26 and the lower surface 28. The upper surface 26 corresponding to each of the lids 24 has indicia 46 printed thereon. The indicia 46 comprise numbers and the numbers 46 may range between one and four. Thus, each of the wells 22 is numerically identified.

An alarm unit 48 is coupled to the box 12 and the alarm unit 48 may be manipulated. The alarm unit 48 is programmable to emit a selected one of an audible alarm, a vibratory alarm and a visual alarm at selected intervals. Thus, the alarm unit 48 generates a reminder to take the medication 14 within the box 12. The alarm unit 48 comprises a processor 50 that is coupled to the box 12. The processor 50 includes an electronic clock 52 and an electronic memory 54. The processor 50 selectively generates a selected one of an audible alarm sequence and a vibratory alarm sequence. The processor 50 may comprise an electronic processor or the like.

A function switch 56 is coupled to the box 12 and the function switch 56 may be manipulated. The function switch 56 is positionable in an audible position and a vibrate position. Thus, processor 50 selectively generates a corresponding one of the audible alarm sequence and the vibratory alarm sequence. The function switch 56 may be positioned on the second lateral side 20 of the box 12.

A display 58 is coupled to the box 12 and the display 58 is visible. The display 58 is electrically coupled to the processor 50 to display a time of day and a calendar date. The display 58 may comprise an LED or the like. The display 58 may be positioned on the first lateral side 18 of the box 12.

A plurality of program buttons 60 is provided. Each of the program buttons 60 is coupled to the box 12 and each of the program buttons 60 may be manipulated. Each of the program buttons 60 is electrically coupled to the processor 50. Each of the program buttons 60 assigns a selected time and date for the medication 14 in each of the wells 22 to be taken. Thus, the processor 50 generates the corresponding audible alarm sequence and the vibratory alarm sequence for each of the wells 22.

The plurality of program buttons 60 may include an hour button 62, a minute button 64 and a set button 66. The hour button 62 may select an hour of the day to take the medication 14. The minute button 64 may select a minute of the day to take the medication 14. The set button 66 may store the selected hour and minute in the electronic memory 54. The display 58 displays the selected time and date while the processor 50 is being programmed.

A plurality of light emitters 68 is provided. Each of the light emitters 68 is coupled to the box 12 and each of the light emitters 68 emits light. Each of the light emitters 68 is positioned on the top side 16 of the box 12. Each of the light emitters 68 is aligned with the aperture 40 in a corresponding one of the lids 24. Thus, each of the light emitters 68 extends though the corresponding lid 24 when the corresponding lid 24 is in the closed position.

Each of the light emitters 68 is electrically coupled to the processor 50. The light emitter 68 corresponding to each of the lids 24 emits light when the processor 50 generates the audible alarm sequence and the vibratory alarm sequence for the corresponding well 22. Thus, each of the light emitters 68 emits the visual alert thereby facilitating the light emitter 68 to remind a user to take the medication 14 in the corresponding well 22. Each of the light emitters 68 may comprise an LED or the like.

A speaker 70 is coupled to the box 12 such that the speaker 70 emits the audible alarm. The speaker 70 is electrically coupled to the processor. The processor 50 turns the speaker 70 on when the processor 50 generates the audible alarm sequence. Thus, the speaker 70 reminds the user to take the medication 14. The electronic memory 54 may store a digital vocal phrase such as "Time to take your medication." or the like. The speaker 70 may emit the vocal phrase.

A volume switch 71 is coupled to the box 12 and the volume switch 71 may be manipulated. The volume switch 71 is electrically coupled to the processor 50. The volume switch 71 adjusts the speaker 70 between a minimum volume and a maximum volume. The volume switch 71 may be positioned on the second lateral side 20 of the box 12.

A vibrator 72 is coupled to the box 12. The vibrator 72 engages the box 12 such that the vibrator 72 selectively vibrates the box 12. Thus, the vibrator 72 provides the vibratory alarm. The vibrator 72 is electrically coupled to the processor 50 and the processor 50 turns the vibrator 72 on when the processor 50 generates the vibratory alarm sequence. The vibrator 72 may comprise a mechanical vibration unit or the like.

A power supply 74 is coupled to the box 12. The power supply 74 is electrically coupled to the processor 50. The power supply 74 comprises at least one battery 76.

In use, the medication 14 is placed within the wells 22 and the lids 24 are positioned in the closed position. The medication 14 is organized into specified combinations within each of the wells 22. The program buttons 60 are manipulated to program the processor 50 to generate the alarm sequence at the selected time each day. Additionally, the processor 50 is programmed to issue the alarm sequence for a selected well 22 each day. The function switch 56 is manipulated to select the audible alarm and the vibratory alarm.

The processor 50 actuates the speaker 70 and the vibrator 72 depending on whether the function switch 56 is positioned in the audible position or the vibrate position. The processor 50 additionally actuates the light emitter 68 corresponding to the appropriate well 22. Thus, the alarm unit 48 reminds the user to take the medication 14 and reminds the user which well 22 from which the medication 14 is to be retrieved. The alarm unit 48 facilitates the medication 14 to be taken in a recommended combination and at a recommended time and day.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A medication reminder assembly comprising:

a box being configured to have medication placed therein, said box having a top side, said top side having a plurality of wells extending downwardly therein wherein each of said wells is configured to have the medication placed therein, said wells being spaced apart from each other and being distributed on said top side; and an alarm unit being coupled to said box wherein said alarm unit is configured to be manipulated, said alarm unit being programmable to emit a selected one of an audible alarm, a vibratory alarm and a visual alarm at selected intervals thereby facilitating said alarm unit to generate a reminder to take the medication within said box;

a plurality of lids, each of said lids being hingedly coupled to said box wherein said lids are configured to be manipulated thereby facilitating said lids to retain the medication within said box, each of said lids being aligned with an associated one of said wells, each of said lids being positionable in an open position and a closed position, each of said lids having an upper surface and a lower surface, each said lid having an overlapping portion extending around said associated one of said wells, each said lid having a respective ledge coupled to and extending from an underside of said lid, said ledge being inserted into said associated well when said lid is in said closed position.

2. The assembly according to claim 1, wherein each of said lids has an aperture extending through said overlapping portion of said lid and through said upper surface and said lower surface, said upper surface corresponding to each of said lids having indicia being printed thereon, said indicia comprising numbers thereby facilitating each of said wells to be numerically identified.

3. The assembly according to claim 2, further comprising a plurality of light emitters, each of said light emitters being coupled to said box wherein each of said light emitters is configured to emit light, each of said light emitters being positioned on said top side, each of said light emitters being aligned with said aperture in a corresponding one of said lids such that each of said light emitters extends though said corresponding lid when said corresponding lid is in said closed position.

4. The assembly according to claim 3, wherein:

said alarm unit includes a processor, said processor selectively generating an audible alarm sequence and a vibratory alarm sequence; and each of said light emitters is electrically coupled to said processor, said light emitter corresponding to each of said lids emitting light when said processor generates said audible alarm sequence and said vibratory alarm sequence for said corresponding well wherein each of said light emitters is configured to emit said visual alert thereby facilitating said light emitter to remind a user to take the medication in said corresponding well.

5. The assembly according to claim 1, wherein said alarm unit comprises a processor being coupled to said box, said processor including an electronic clock and an electronic memory, said processor selectively generating a selected one of an audible alarm sequence and a vibratory alarm sequence.

6. The assembly according to claim 5, further comprising a function switch being coupled to said box wherein said function switch is configured to be manipulated, said function switch being positionable in an audible position and a vibrate position such that processor selectively generates a corresponding one of said audible alarm sequence and said vibratory alarm sequence.

7. The assembly according to claim 5, further comprising a display being coupled to said box wherein said display is configured to be visible, said display being electrically coupled to said processor wherein said display is configured to display a time of day and a calendar date.

8. The assembly according to claim 7, further comprising:

said box having a plurality of wells; and a plurality of program buttons, each of said program buttons being coupled to said box wherein each of said program buttons is configured to be manipulated, each of said program buttons being electrically coupled to said processor such that each of said program buttons establishes a selected time and date for said processor to generate said corresponding audible alarm sequence and said vibratory alarm sequence for each of said wells, said display displaying said selected time and date while said processor is being programmed.

9. The assembly according to claim 5, further comprising a speaker being coupled to said box such that said speaker emits said audible alarm, said speaker being electrically coupled to said processor such that said processor turns said speaker on when said processor generates said audible alarm sequence wherein said speaker is configured to remind the user to take the medication.

10. The assembly according to claim 5, further comprising a vibrator being coupled to said box, said vibrator engaging said box such that said vibrator selectively vibrates said box thereby facilitating said vibrator to provide said vibratory alarm, said vibrator being electrically coupled to said processor such that said processor turns said vibrator on when said processor generates said vibratory alarm sequence.

11. The assembly according to claim 5, further comprising a power supply being coupled to said box, said power supply being electrically coupled to said processor, said power supply comprising at least one battery.

12. A medication reminder assembly comprising:

a box being configured to have medication placed therein, said box having a top side, said top side having a plurality of wells extending downwardly therein wherein each of said wells is configured to have the medication placed therein, said wells being spaced apart from each other and being distributed on said top side;

a plurality of lids, each of said lids being hingedly coupled to said box wherein said lids are configured to be manipulated thereby facilitating said lids to retain the medication within said box, each of said lids being aligned with an associated one of said wells, each of said lids being positionable in an open position and a closed position, each of said lids having an upper surface and a lower surface, each said lid having an overlapping portion extending around said associated one of said wells, each said lid having a respective ledge coupled to and extending from an underside of said lid, said ledge being inserted into said associated well when said lid is in said closed position, each of said lids having an aperture extending through said overlapping portion of said lid through upper surface and said lower surface, said upper surface corresponding to each of said lids having indicia being printed thereon, said indicia comprising numbers thereby facilitating each of said wells to be numerically identified; and an alarm unit being coupled to said box wherein said alarm unit is configured to be manipulated, said alarm unit being programmable to emit a selected one of an audible alarm, a vibratory alarm and a visual alarm at selected intervals thereby facilitating said alarm unit to generate a reminder to take the medication within said box, said alarm unit comprising:

a processor being coupled to said box, said processor including an electronic clock and an electronic memory, said processor selectively generating a selected one of an audible alarm sequence and a vibratory alarm sequence, a function switch being coupled to said box wherein said function switch is configured to be manipulated, said function switch being positionable in an audible position and a vibrate position such that processor selectively generates a corresponding one of said audible alarm sequence and said vibratory alarm sequence, a display being coupled to said box wherein said display is configured to be visible, said display being electrically coupled to said processor wherein said display is configured to display a time of day and a calendar date, a plurality of program buttons, each of said program buttons being coupled to said box wherein each of said program buttons is configured to be manipulated, each of said program buttons being electrically coupled to said processor such that each of said program buttons establishes a selected time and date for said processor to generate said corresponding audible alarm sequence and said vibratory alarm sequence for each of said wells, said display displaying said selected time and date while said processor is being programmed, and a plurality of light emitters, each of said light emitters being coupled to said box wherein each of said light emitters is configured to emit light, each of said light emitters being positioned on said top side, each of said light emitters being aligned with said aperture in a corresponding one of said lids such that each of said light emitters extends though said corresponding lid when said corresponding lid is in said closed position, each of said light emitters being electrically coupled to said processor, said light emitter corresponding to each of said lids emitting light when said processor generates said audible alarm sequence and said vibratory alarm sequence for said corresponding well wherein each of said light emitters is configured to emit said visual alert thereby facilitating said light emitter to remind a user to take the medication in said corresponding well, a speaker being coupled to said box such that said speaker emits said audible alarm, said speaker being electrically coupled to said processor such that said processor turns said speaker on when said processor generates said audible alarm sequence wherein said speaker is configured to remind the user to take the medication, a vibrator being coupled to said box, said vibrator engaging said box such that said vibrator selectively vibrates said box thereby facilitating said vibrator to provide said vibratory alarm, said vibrator being electrically coupled to said processor such that said processor turns said vibrator on when said processor generates said vibratory alarm sequence, and a power supply being coupled to said box, said power supply being electrically coupled to said processor, said power supply comprising at least one battery.

* * * * *